US011273571B2

(12) United States Patent
Bucks

(10) Patent No.: US 11,273,571 B2
(45) Date of Patent: Mar. 15, 2022

(54) CUTTING HEAD ASSEMBLY FOR CENTRIFUGAL CUTTING APPARATUS AND CENTRIFUGAL APPARATUS EQUIPPED

(71) Applicant: FAM, Kontich (BE)

(72) Inventor: Brent L. Bucks, Lakewood Ranch, FL (US)

(73) Assignee: FAM, Kontich (BE)

( * ) Notice: Subject to any disclaimer, the term of this patent is extended or adjusted under 35 U.S.C. 154(b) by 0 days.

(21) Appl. No.: 16/267,394

(22) Filed: Feb. 5, 2019

(65) Prior Publication Data

US 2020/0246995 A1 Aug. 6, 2020
US 2020/0353637 A9 Nov. 12, 2020

Related U.S. Application Data

(62) Division of application No. 14/347,522, filed as application No. PCT/EP2012/069296 on Sep. 28, 2012, now Pat. No. 10,293,505.

(Continued)

(51) Int. Cl.
*B26D 7/06* (2006.01)
*B26D 7/26* (2006.01)

(Continued)

(52) U.S. Cl.
CPC ..... *B26D 7/0691* (2013.01); *B26D 1/0006* (2013.01); *B26D 1/62* (2013.01); *B26D 7/2614* (2013.01)

(58) Field of Classification Search
CPC .. B26D 7/0691; B26D 7/2614; B26D 7/2628; B26D 2210/02; B26D 1/0006;

(Continued)

(56) References Cited

U.S. PATENT DOCUMENTS 1,474,797 A * 11/1923 Spicer ..... B23D 35/008 83/403
2,195,879 A * 4/1940 Urschel ..... B26D 1/03 83/403

(Continued)

FOREIGN PATENT DOCUMENTS

| | | |
|---|---|---|
| EP | 0301996 | 2/1989 |
| WO | 02068122 | 9/2002 |
| WO | 2004106015 | 12/2004 |

OTHER PUBLICATIONS

Melone, Larry, What is the Difference Between a Bolt and a Screw?, Nov. 2010, https://www.melfast.com/blog/2010/11/what-is-the-difference-between-a-bolt-and-a-screw/, obtained Dec. 17, 2020 (Year: 2010).*

(Continued)

*Primary Examiner* — Evan H MacFarlane
(74) *Attorney, Agent, or Firm* — N.V. Nederlandsch Octrooibureau; Catherine A. Shultz; Katelyn J. Bernier

(57) ABSTRACT

Cutting head assembly for a centrifugal cutting apparatus, comprising a plurality of drum stations, at least one of which is a cutting station, provided for together forming a drum, and fixing parts provided for assembling and holding the drum stations together. The drum stations have overlapping parts with each time at least one receiving part for receiving one of the fixing parts, such that in assembled condition the adjacent drum stations are each time fixed to each other by means of at least one of the fixing parts at the overlapping parts of the adjacent drum stations.

13 Claims, 14 Drawing Sheets

Related U.S. Application Data

(60) Provisional application No. 61/540,246, filed on Sep. 28, 2011.

(51) Int. Cl.
*B26D 1/62* (2006.01)
*B26D 1/00* (2006.01)

(58) Field of Classification Search
CPC ... B26D 1/03; B26D 1/36; B26D 1/62; B26D 2001/0033; B26D 7/0608; B26D 1/38; Y10S 83/932; Y10T 83/6473
See application file for complete search history.

(56) References Cited

U.S. PATENT DOCUMENTS

| | | | | | |
|---|---|---|---|---|---|
| 2,436,410 | A * | 2/1948 | Urschel | B26D 3/18 | 83/404.3 |
| 2,875,800 | A | 3/1959 | Urschel | | |
| 3,139,128 | A * | 6/1964 | Urschel | B26D 1/0006 | 83/111 |
| 3,196,916 | A | 7/1965 | Urschel | | |
| 3,395,742 | A | 8/1968 | Sanders | | |
| 3,823,880 | A | 7/1974 | Urschel | | |
| 3,888,426 | A | 6/1975 | Urschel et al. | | |
| 3,989,196 | A | 11/1976 | Urschel | | |
| 4,042,183 | A | 8/1977 | Cumpston | | |
| 4,523,503 | A | 6/1985 | Julian et al. | | |
| 4,604,925 | A | 8/1986 | Wisdom | | |
| 4,610,397 | A | 9/1986 | Fischer et al. | | |
| 5,274,899 | A | 1/1994 | Sentagnes et al. | | |
| 5,555,787 | A | 9/1996 | Barber et al. | | |
| 5,694,824 | A | 12/1997 | Jacko et al. | | |
| 5,819,628 | A | 10/1998 | Cogan et al. | | |
| 5,964,138 | A | 10/1999 | Metzner et al. | | |
| 6,155,151 | A * | 12/2000 | Reichert | B26D 7/2614 | 83/342 |
| 7,270,040 | B2 | 9/2007 | King et al. | | |
| 10,617,141 | B2 * | 4/2020 | Domingo Varona | B26D 1/03 | |
| 10,632,639 | B2 * | 4/2020 | Fant | B26D 3/28 | |
| 2004/0216572 | A1 | 11/2004 | King et al. | | |
| 2004/0237747 | A1 | 12/2004 | King | | |
| 2006/0172816 | A1 | 8/2006 | Johnson | | |
| 2008/0022822 | A1 | 1/2008 | Jacko et al. | | |
| 2009/0202694 | A1 | 8/2009 | Julian et al. | | |
| 2010/0015312 | A1 | 1/2010 | Bellmunt-Molins | | |
| 2010/0130981 | A1 | 5/2010 | Richards | | |
| 2013/0276604 | A1 | 10/2013 | King et al. | | |
| 2014/0007751 | A1 | 1/2014 | Michel et al. | | |
| 2014/0060278 | A1 | 3/2014 | Koide | | |
| 2014/0230620 | A1 * | 8/2014 | Bucks | B26D 1/36 | 83/403 |
| 2014/0230621 | A1 * | 8/2014 | Bucks | B26D 1/36 | 83/403 |
| 2014/0257413 | A1 | 9/2014 | Appenzeller et al. | | |
| 2019/0210239 | A1 * | 7/2019 | Baxter | B26D 1/03 | |
| 2019/0329437 | A1 * | 10/2019 | Gereg | B26D 1/03 | |

OTHER PUBLICATIONS

Merriam-Webster dictionary, definition of 'setscrew', https://www.merriam-webster.com/dictionary/setscrew, obtained Dec. 17, 2020.*
Brunner-Anliker product information on the IR 250 Industrial Food Process, available at https://www.brunner-anliker.com/en/food-industry/nut-and-cheese-graters/ir-250/.

* cited by examiner

CUTTING HEAD ASSEMBLY FOR CENTRIFUGAL CUTTING APPARATUS AND CENTRIFUGAL APPARATUS EQUIPPED

TECHNICAL FIELD

The present invention relates to a cutting head assembly for a centrifugal cutting apparatus and a centrifugal cutting apparatus equipped with such a cutting head assembly, such as for example a food cutting apparatus.

BACKGROUND ART

A centrifugal cutting apparatus comprises an impeller which can rotate concentrically within a cutting head to impart centrifugal force to the products to be cut. The cutting head is an assembly of a plurality of cutting stations, also called shoes, which each carry a cutting element and an opposing part (gating surface) for cutting the products fed into the cutting head.

A centrifugal cutting apparatus is for example known from U.S. Pat. No. 7,270,040.

DISCLOSURE OF THE INVENTION

It is an aim of this invention to provide an improved cutting head assembly for a centrifugal cutting apparatus.

This aim is achieved according to the invention with the cutting head assembly comprising the technical characteristics of the first claim.

As used herein, "rotational speed" is intended to mean the speed at which an object rotates around a given axis, i.e. how many rotations the object completes per time unit. A synonym of rotational speed is speed of revolution. Rotational speed is commonly expressed in RPM (revolutions per minute).

As used herein, "cutting velocity" is intended to mean the speed at which a cutting element cuts through a product or alternatively states the speed at which a product passes a cutting element. Cutting velocity is commonly expressed in m/sec.

As used herein, a "cutting element" is intended to mean any element which is configured for cutting a particle or a piece from an object or otherwise reducing the size of the object, such as for example a knife, a blade, a grating surface, a cutting edge, a milling element, a comminuting element, a cutting element having multiple blades, etc., the foregoing being non-limiting examples.

According to the present invention, the cutting head is an assembly that comprises a plurality of drum stations, at least one of which is a cutting station, which together form a drum. In the following, for the sake of simplicity, it will be assumed that all the drum stations are cutting stations, but the invention is not restricted thereto.

The assembly comprises fixing parts, e.g. bolts, by means of which the cutting stations are assembled and held together. Each cutting station comprises a cutting element at one end and an opposing part at the other end. The cutting elements are provided for cutting or otherwise reducing products fed into the cutting head into smaller parts. The size of the cut products is set by the gap between the cutting element and the opposing part of the subsequent cutting station.

According to the invention, the cutting stations have overlapping parts, for example at the top and at the bottom of the drum, adapted for receiving the fixing parts, e.g. with each time a bore for receiving a bolt, by means of which the drum is held together. This means that the adjacent cutting stations are each time fixed to each other e.g. by means of at least one bolt which extends through the bore in the overlapping parts of the adjacent cutting stations. It has been found that by fixing the cutting stations to each other in this way, the number of components of the cutting head assembly can be significantly reduced with respect to the prior art and that the cutting stations can accurately define the slice thickness as they are in an absolute relationship to each other.

In embodiments according to the invention, the assembly comprises top and bottom mounting rings as sizing elements (defining the diameter of the drum) and the overlapping parts of adjacent cutting stations and the top and bottom mounting rings are adapted for being assembled by each time a single bolt, such that one bolt extends through the overlapping parts of adjacent cutting stations as well as into the top/bottom mounting ring.

In embodiments according to the invention, a sizing arrangement apart from the cutting head assembly may also be used for setting the diameter of the drum. As an example, a sizing arrangement can be used which comprises a plug, possibly top and bottom plugs (circular members), having the desired diameter, around which the cutting stations are placed and subsequently the bolts at the overlapping parts are tightened so that the assembly is conformed to the diameter of the plug(s). In another embodiment, a base plate of the cutting head assembly could also be configured for functioning as a sizing element in this way, i.e. a plug which is actually part of the assembly. In these embodiments, the top and bottom mounting rings are not necessary, however the two may be combined or mixed (e.g. a plug at the bottom and an outer ring at the top etc.)

In embodiments according to the invention, the cutting stations can be bolted together at the overlapping parts with a spacer in between, the spacer defining the size of the gap between the cutting element and the opposing part of the subsequent cutting station. In this way, the size of the gap can be easily adjusted by exchanging the spacer for one of another size.

In embodiments according to the invention, other gap setting elements may also be provided. For example, the gap setting elements may comprise a plurality of set screws, the overlapping parts of adjacent cutting stations comprising on the one hand bores for receiving the set screws and on the other hand surfaces for abutting the set screws, such that the length of the set screws define the size of the gap between the cutting element and the opposing part of the subsequent cutting station. In this way, the size of the gap can be easily adjusted by exchanging the set screw for one of another length.

It is an advantage of the cutting head assembly of embodiments according to the invention that the number of components to be assembled can be reduced with respect to the prior art and consequently the assemblage can be simplified. For example, by means of one bolt at the top and one bolt at the bottom, two adjacent cutting stations can be fixed to each other as well as to the top and bottom mounting rings and simultaneously the gap size can be set by placing the appropriate spacer in between the overlapping parts.

In embodiments according to the invention, the cutting stations are provided with elongate grooves on the inside of the drum for providing relief for stones entering the cutting head along with the product to be cut and can avoid that such stones damage the cutting elements. On each cutting station, the grooves start at the end where the cutting element is located and gradually increase towards the end where the opposing part is located, so that the grooves reach their maximum depth at this end. This provides for a longer settling time for stones which enter the cutting head along with product to be cut as compared to prior art cutting heads having a so-called sand gate. Further, the grooves reduce friction between product which is rotated inside of the drum and the inside wall of the cutting stations.

In a cutting apparatus which comprises such cutting stations with elongate grooves on the inside, the impeller can advantageously be equipped with impeller paddles which have grooves on the outer peripheral edge which align with the grooves on the cutting stations. This has the further advantage that stones which are caught in the elongate grooves on the inside of the drum are not further driven by the impeller, which can further reduce the risk of damage to the cutting elements.

In embodiments according to the invention, the grooves can span more than half the length of the cutting station.

In embodiments according to the invention, the top and bottom mounting rings comprise protrusions extending radially inwardly at the location of the overlapping parts of the adjacent cutting stations. In this way, the mounting rings are spaced from the cutting stations. This can reduce the weight of the rings and can minimise the contact area between the rings and the cutting stations to allow for more accurate positioning the cutting stations upon assemblage.

BRIEF DESCRIPTION OF THE DRAWINGS

The invention will be further elucidated by means of the following description and the appended drawings.

MODES FOR CARRYING OUT THE INVENTION

Figure 1:
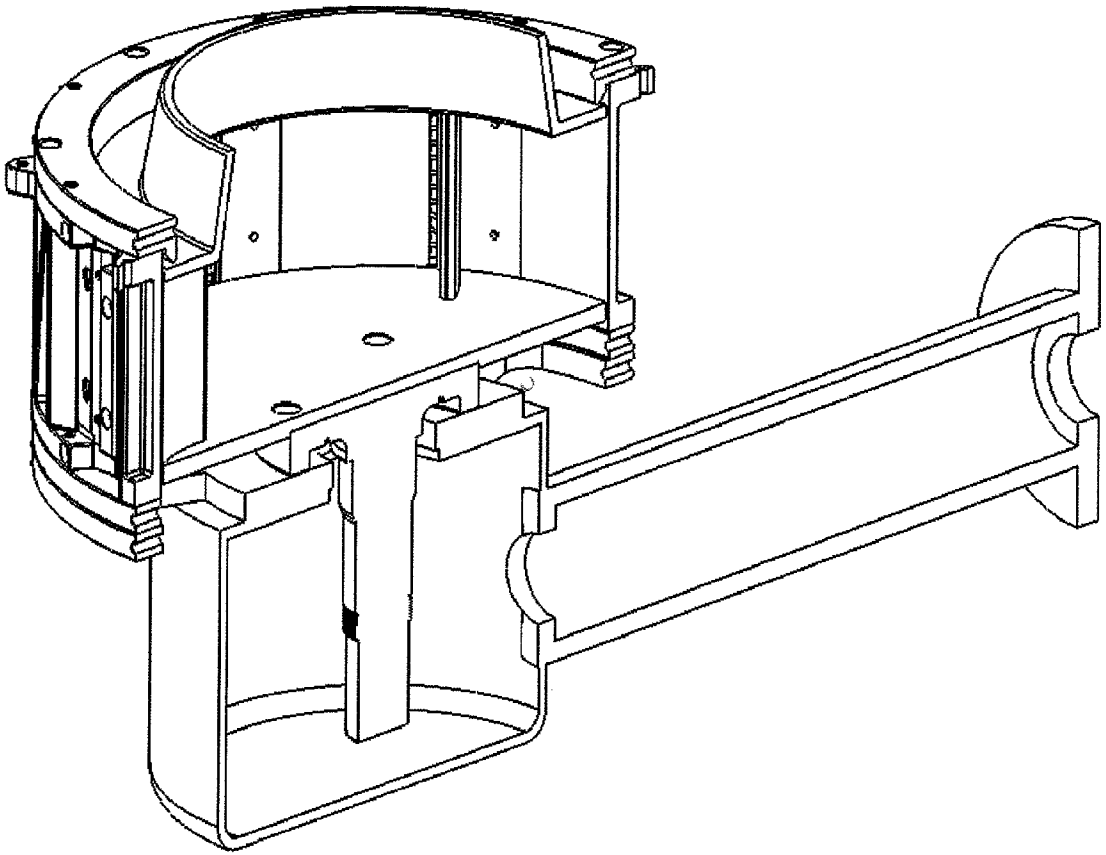
FIG. 1 (prior art)
FIG. 1 shows a prior art centrifugal cutting apparatus.

The present invention will be described with respect to particular embodiments and with reference to certain drawings but the invention is not limited thereto but only by the claims. The drawings described are only schematic and are non-limiting. In the drawings, the size of some of the elements may be exaggerated and not drawn on scale for illustrative purposes. The dimensions and the relative dimensions do not necessarily correspond to actual reductions to practice of the invention.

Furthermore, the terms first, second, third and the like in the description and in the claims, are used for distinguishing between similar elements and not necessarily for describing a sequential or chronological order. The terms are interchangeable under appropriate circumstances and the embodiments of the invention can operate in other sequences than described or illustrated herein.

Moreover, the terms top, bottom, over, under and the like in the description and the claims are used for descriptive purposes and not necessarily for describing relative positions. The terms so used are interchangeable under appropriate circumstances and the embodiments of the invention described herein can operate in other orientations than described or illustrated herein.

Furthermore, the various embodiments, although referred to as "preferred" are to be construed as exemplary manners in which the invention may be implemented rather than as limiting the scope of the invention.

The term "comprising", used in the claims, should not be interpreted as being restricted to the elements or steps listed thereafter; it does not exclude other elements or steps. It needs to be interpreted as specifying the presence of the stated features, integers, steps or components as referred to, but does not preclude the presence or addition of one or more other features, integers, steps or components, or groups thereof. Thus, the scope of the expression "a device comprising A and B" should not be limited to devices consisting only of components A and B, rather with respect to the present invention, the only enumerated components of the device are A and B, and further the claim should be interpreted as including equivalents of those components.

FIG. 1 shows a prior art centrifugal food cutting apparatus, but note that it can be equipped with cutting heads according to the invention. In this apparatus, the cutting head is stationary and only the impeller rotates. The rotation can either be in clockwise or counterclockwise direction (viewed from the top), depending on the orientation of the cutting elements on the cutting head, though clockwise is more common.

Figure 2:
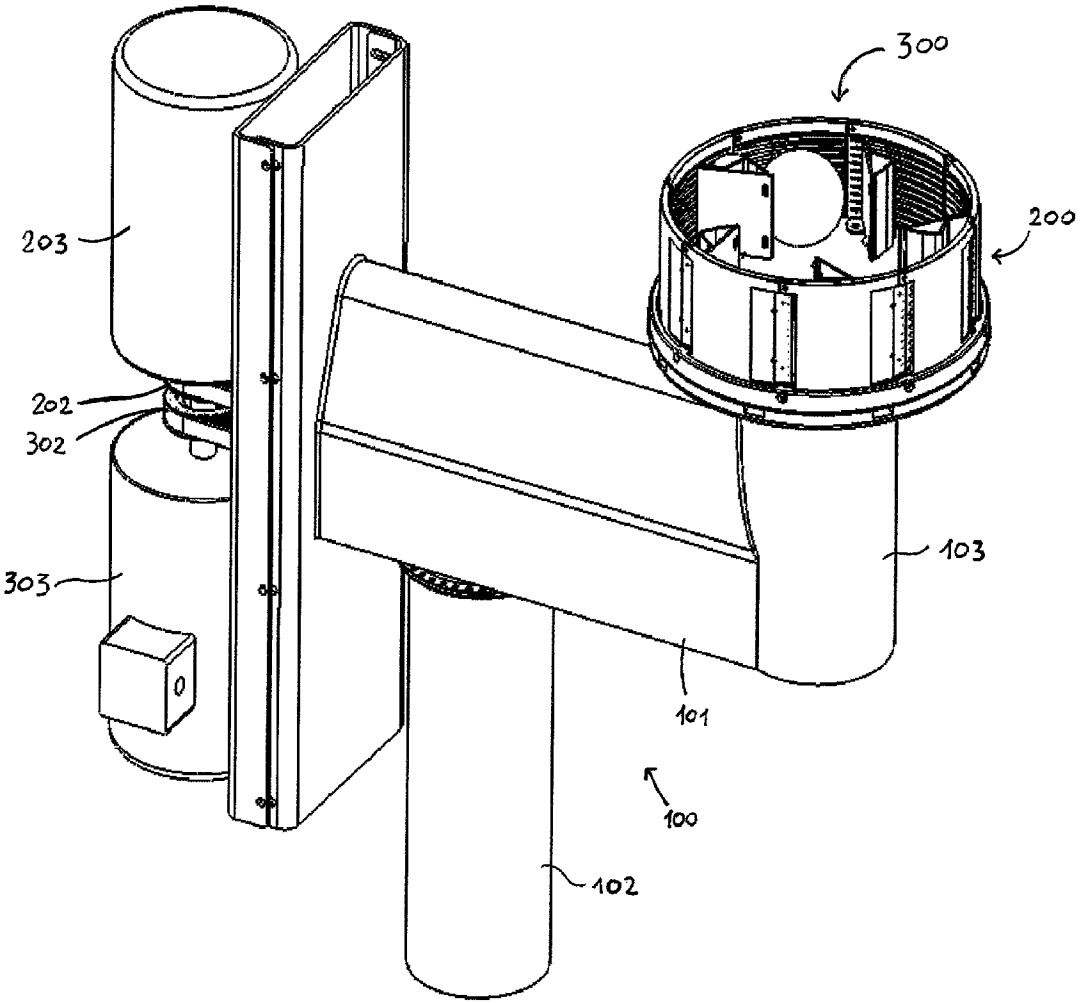
FIG. 2 shows an embodiment of a centrifugal cutting apparatus according to the invention.

FIG. 2 shows a centrifugal food cutting apparatus according to the invention. In this apparatus both the cutting head and the impeller are rotatable. The rotation direction can be both clockwise at different rotational speeds, counterclockwise at different rotational speeds, or opposite directions, as long as the food product is moved towards the periphery by centrifugal force and at the periphery the food product and the knives on the cutting head are moved towards each other for cutting.

The cutting apparatus shown in FIG. 2 (see also FIG. 9) comprises a base 100 which carries a rotatable cutting head 200 and an impeller 300, adapted for rotating concentrically within the cutting head. A first drive mechanism, which is constituted by a first drive shaft 301, drive belt 302 and motor 303, is provided for driving the rotation of the impeller 300. A second drive mechanism, which is constituted by a second drive shaft 201, drive belt 202 and motor 203, is provided for driving the rotation of the cutting head 200. The first and second drive shafts are concentrical. The second drive shaft 201 which drives the cutting head 200 is rotatably mounted by means of bearings 104, 105 inside a stationary outer bearing housing 103, which forms part of the base 100. The first drive shaft 301 which drives the impeller is rotatably mounted by means of bearings 106, 107 inside the second drive shaft 201. As shown, these bearings 104-107 are tapered roller bearings, slanting in opposite directions, which is preferred in view of withstanding the forces which occur during operation of the apparatus. Alternatively, angular contact bearings could be used, or any other bearings deemed suitable by the person skilled in the art.

The base 100 comprises an arm 101, which is rotatably mounted on a post 102, so that the cutting head 200 and impeller 300 can be rotated away from the cutting position for cleaning, maintenance, replacement etc.

Figure 9:
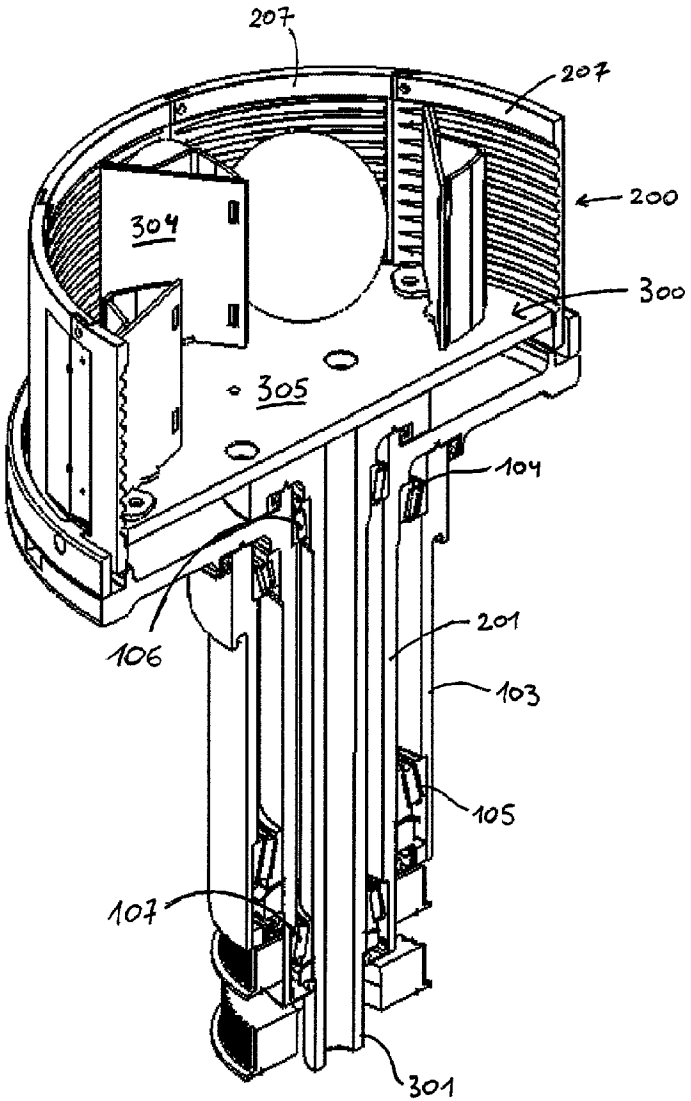
FIG. 9 shows a detail of part of the centrifugal cutting apparatus of FIG. 2.
Figure 11:
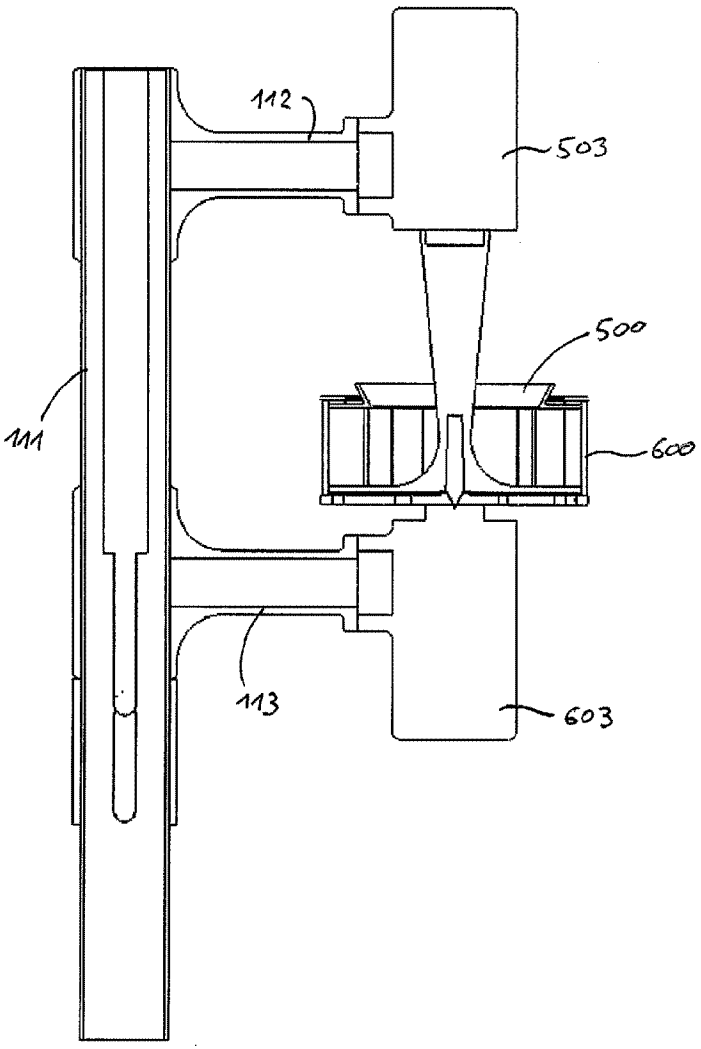
FIGS. 10-14 show an alternative embodiment of a centrifugal cutting apparatus according to the invention.
Figure 10:
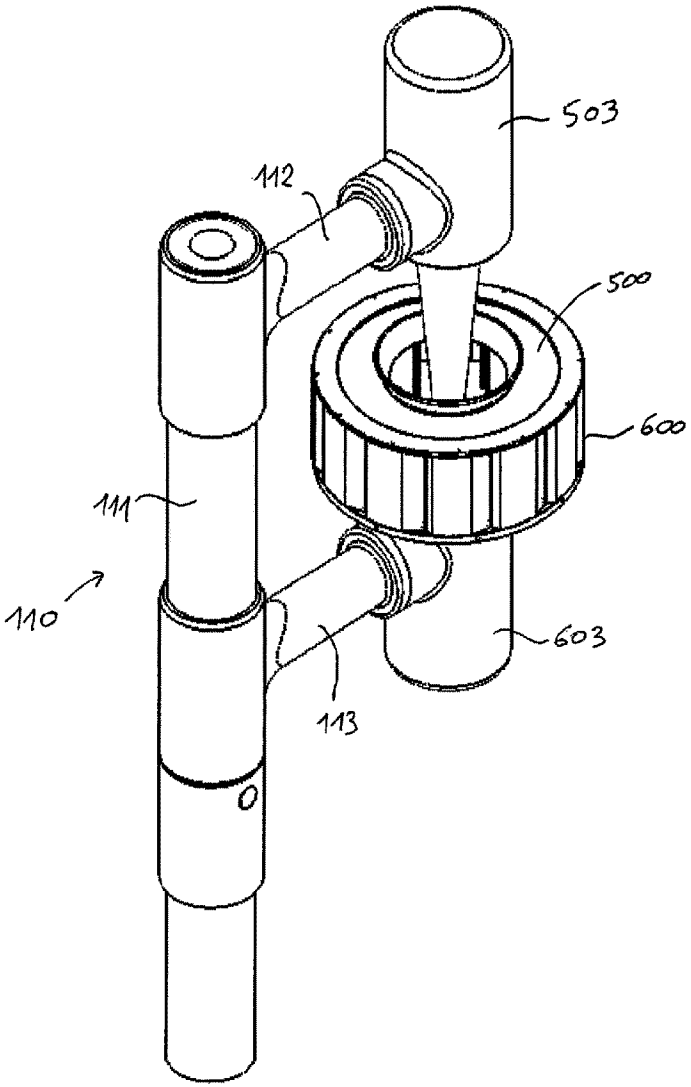
Figure 12:
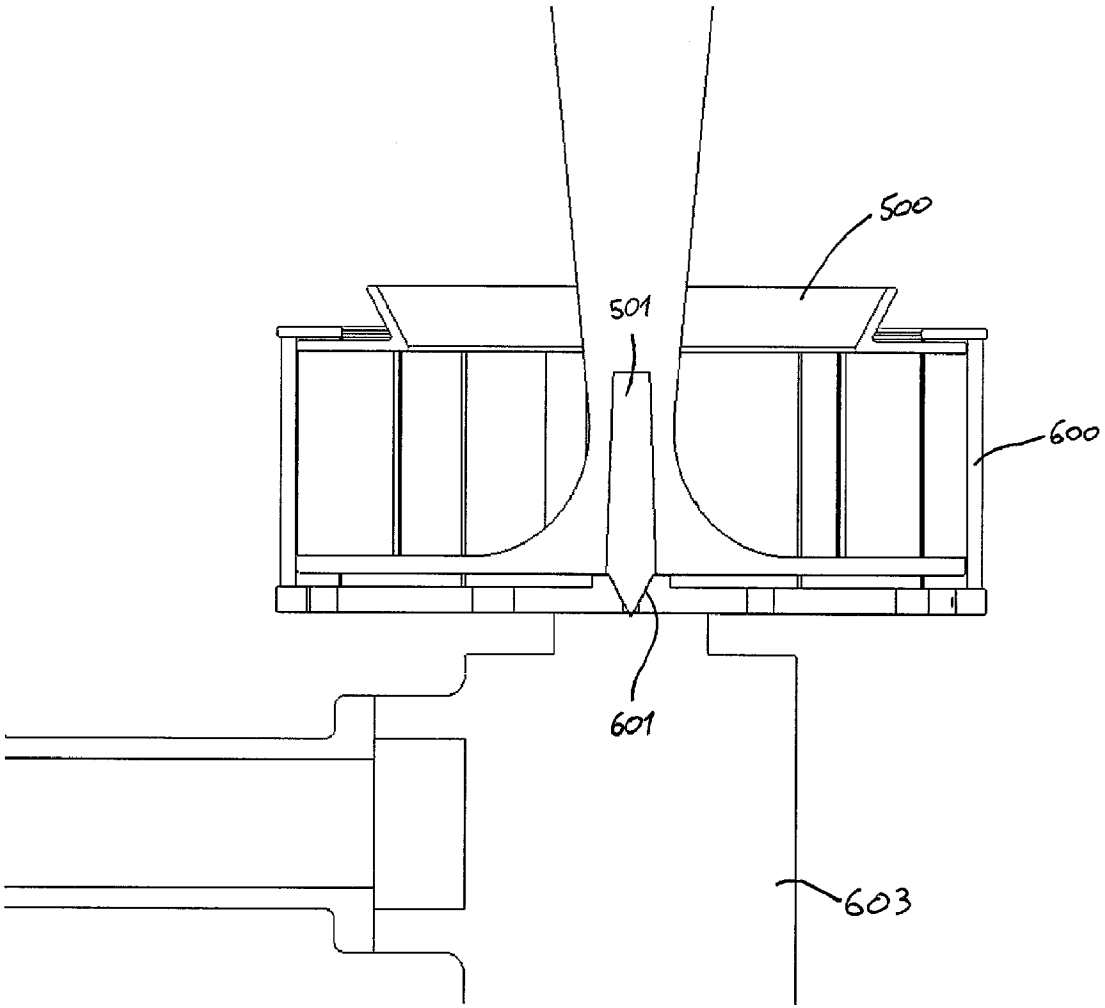

FIG. 9 shows the impeller 300 and cutting head 200 in more detail. The impeller 300 is releasably fixed to the first drive shaft 301 for rotation inside the cutting head 200. The cutting head 200 is a cylindrical assembly comprising a plurality of cutting stations 207 fixed to each other by bolts at overlapping parts, each comprising one cutting element 208. The assembly is releasably fixed to the second drive shaft 201. The cutting stations 207 have an adjustable gap between the cutting element 208 (FIG. 3) and an opposing part 209 (FIG. 3) on the subsequent cutting station, i.e. for adjusting the thickness of the part which is cut off. The top sides of the cutting head 200 and impeller 300 are open. In use, product to be cut is supplied into the cutting head from this open top side, lands on the bottom plate 305 of the impeller and is moved towards the cutting elements 208 firstly by centrifugal force, which is imparted to the product by the rotation of the impeller 300, and secondly by the paddles 304 of the impeller.

In alternative embodiments (not shown), the drum can also be composed of a plurality of drum stations which are not all cutting stations. For example, typically in conjunction with a dicing unit mounted at the outside of the cutting head which is provided for further cutting a slice cut off by the cutting head, there would be only one cutting station.

The cutting head 200 is fitted with cutting elements 208, for example blades which make straight cuts in the product, for example to make potato chips. As an alternative, corrugated cutting elements could be fitted in order to make for example crinkle cut potato chips or shreds.

In an alternative embodiment (not shown), the cutting stations comprise each a larger blade and a number of (one or more) smaller, so-called julienne tabs extending at an angle thereto, in particular substantially perpendicular thereto. In this embodiment, the julienne tabs can be welded onto the larger blades, but they could also be removably fixed thereto. In particular, the julienne tabs can be fixed to and extend perpendicular to the bevel of the larger blades, but they could also be fixed to the larger blades behind the bevel. The front cutting edges of the julienne tabs can be slightly behind the front cutting edge of the larger blade, all at the same distance. Alternatively, they could also be located at varying distances from the front cutting edge of the larger blade, for example in a staggered or alternating configuration. The julienne tabs can be stabilised by means of slots in the subsequent cutting station, so that during operation stresses can be relieved and the desired cut can be better maintained. The slots can extend a given distance into the rear end of the cutting stations to accommodate for the variable positions of the julienne tabs upon varying the gap. With this cutting head, the product is cut in two directions at once. It can for example be used to cut French fries from potatoes or to cut lettuce.

In further alternatives, cutting stations can be used with cutting edges for milling or comminuting products (e.g. salt, spices) or viscous liquids (e.g. butters, spreads). With these cutting stations, the apparatus can also be used for manufacturing pharmaceutical products like for example ointments.

In further alternatives, cutting stations can be used with grating surfaces for making grated cheese, or with any other cutting elements known to the person skilled in the art.

Figure 3:
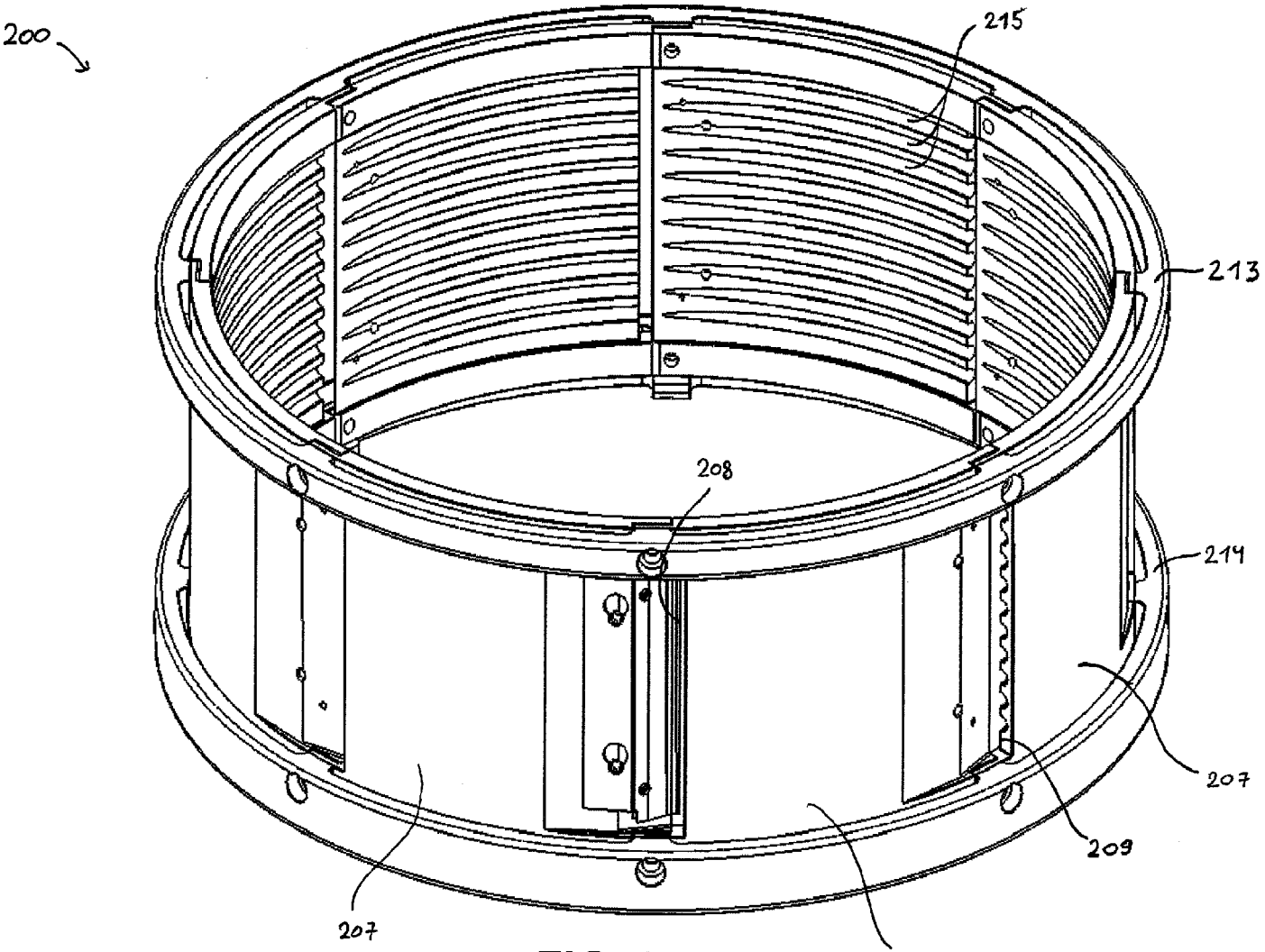
FIG. 3 shows an embodiment of a cutting head assembly according to the invention.
Figure 8:
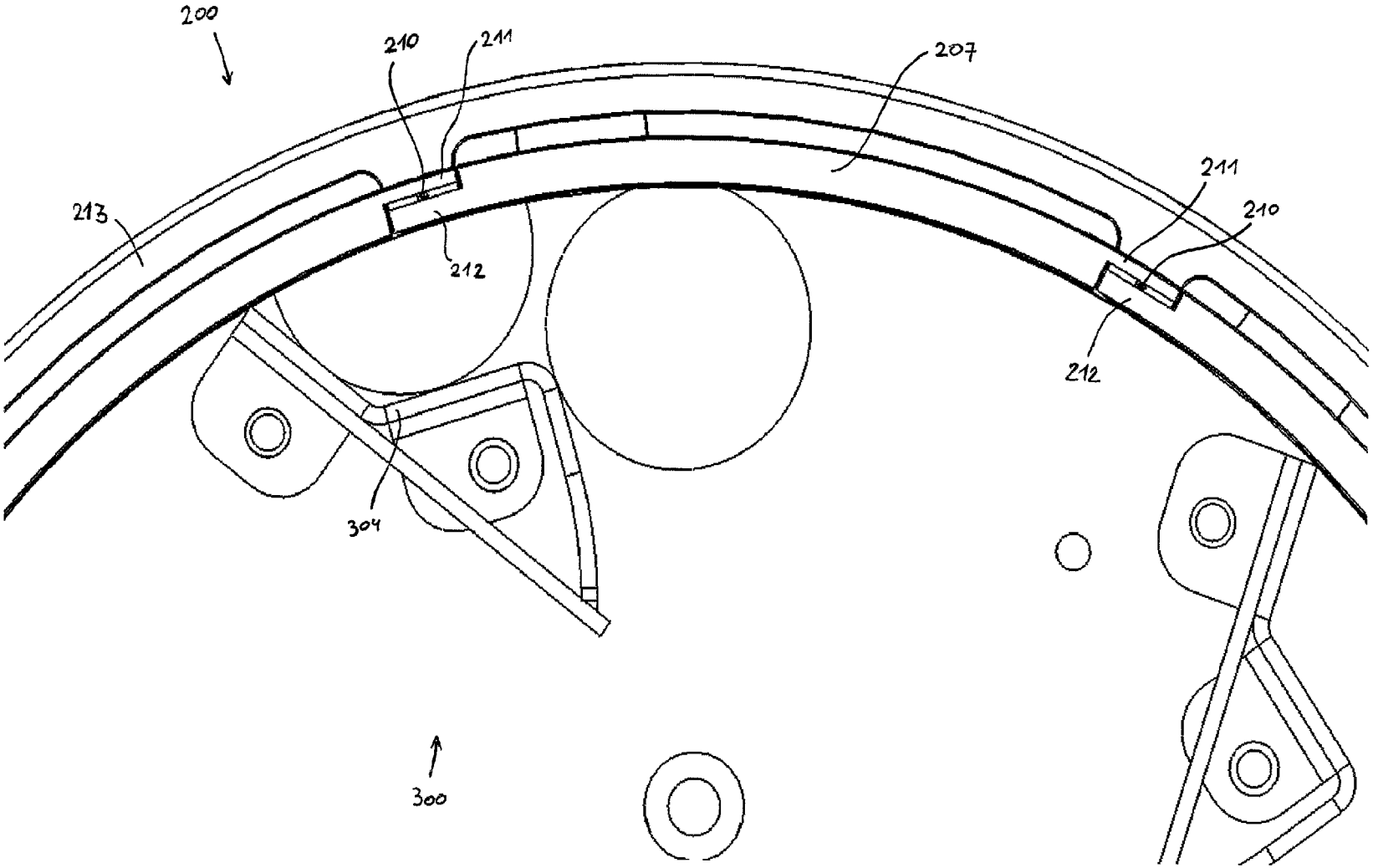
FIG. 8 shows a detail of a centrifugal cutting apparatus according to the invention.

FIGS. 3 and 8 show an embodiment of a cutting head assembly according to the invention. The cutting head 200 is an assembly of a plurality of cutting stations 207 which together form a drum. The cutting stations are assembled and held together by means of a bolts (not shown) through bores in overlapping parts 211, 212, which are provided at the top and at the bottom of the drum and are each extensions of the body of the cutting stations, extending along the circumference of the drum. The bores through these overlapping parts are oversized (at least in circumferential direction—they may be oval) so that there is an amount of play between the bores and the bolts and the diameter of the drum is to a certain extent variable. This allows the drum to be exactly sized by means of an appropriate sizing element. In the embodiment shown in FIGS. 3 and 8, top and bottom mounting rings 213, 214 are used as sizing elements to define the correct diameter of the drum. Each cutting station comprises a cutting element 208 (only one is shown in FIG. 3) at one end and an opposing part 209 at the other end. The cutting elements are provided for cutting or otherwise reducing products fed into the cutting head into smaller parts. The size of the cut products is set by the gap between the cutting element 208 (knife edge) and the opposing part 209 (gate edge) of the subsequent cutting station. In this embodiment, the top and bottom mounting rings 213, 214 and the overlapping parts 211, 212 of adjacent cutting stations are adapted for being assembled by each time a single bolt, such that one bolt extends through the overlapping parts 211, 212 of adjacent cutting stations as well as into the top/bottom mounting ring 213, 214. The cutting stations are bolted together at the overlapping parts with a spacer 210 in between, the spacer 210 defining the size of the gap between the cutting element 208 and the opposing part 209 of the subsequent cutting station. The top and bottom mounting rings 213, 214 comprise protrusions extending radially inwardly at the location of the overlapping parts of the adjacent cutting stations. In this way, the mounting rings are spaced from the cutting stations.

Figure 4:
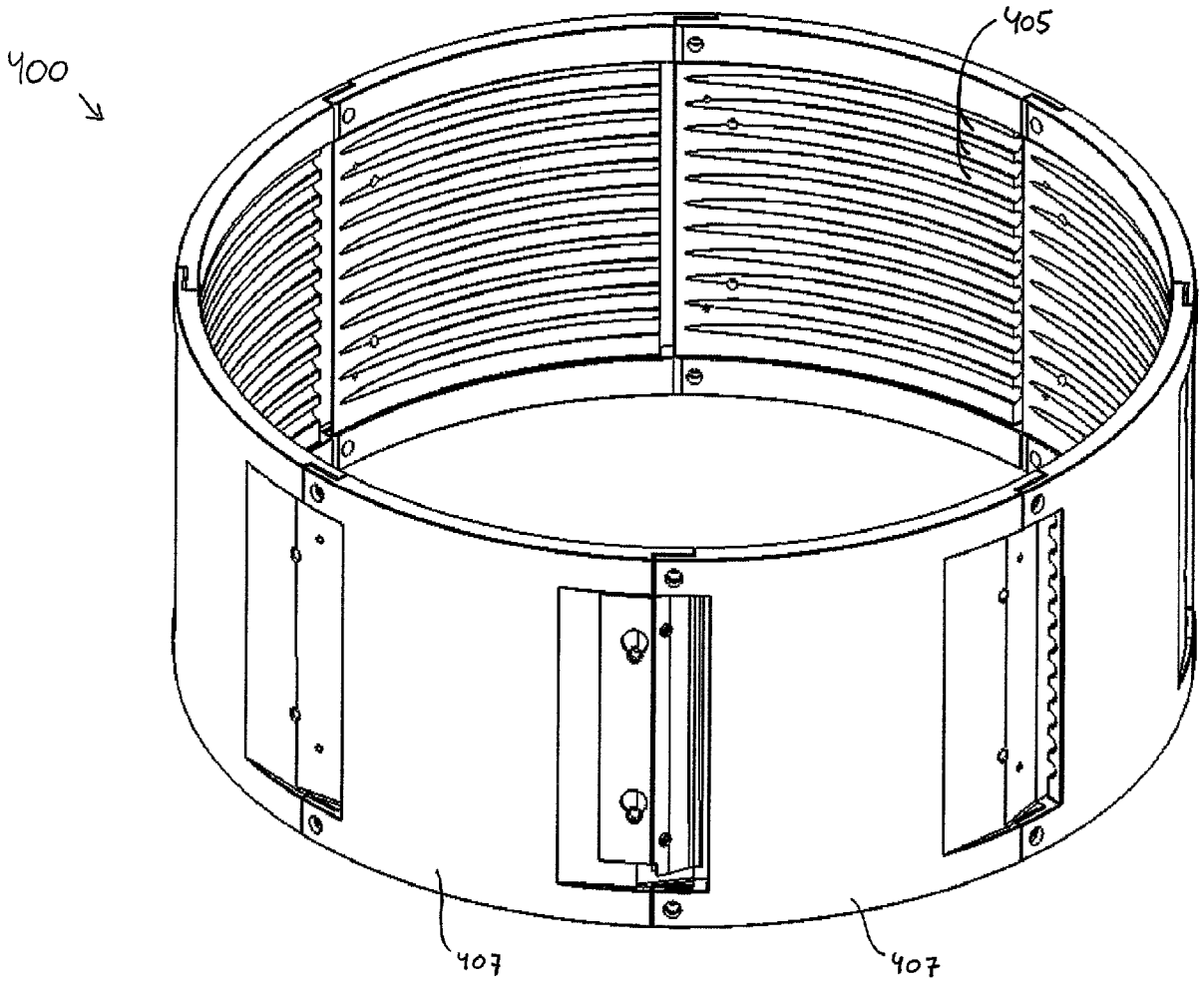
FIG. 4 shows another embodiment of a cutting head assembly according to the invention.
Figure 7:
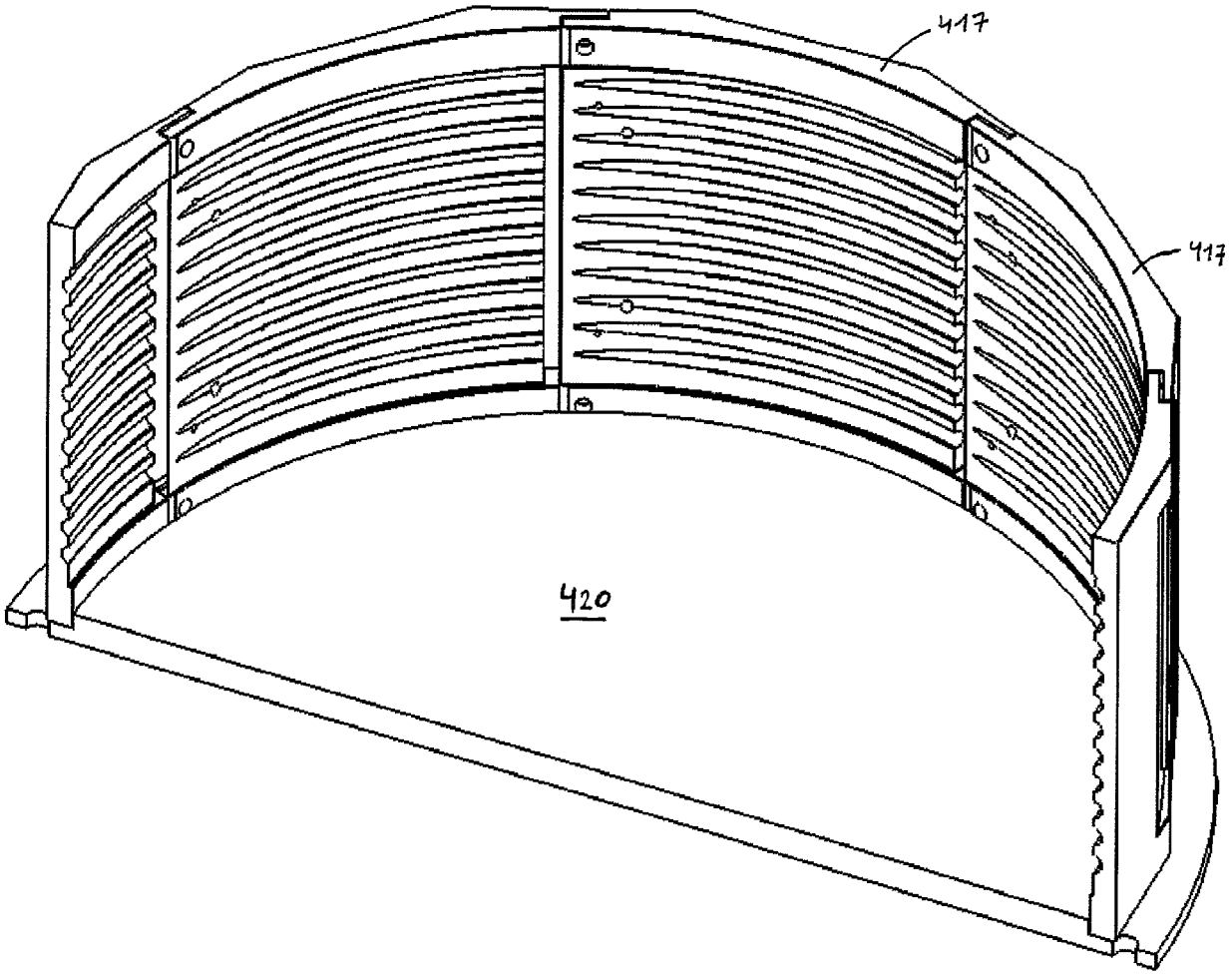
FIG. 7 shows a possible sizing arrangement for setting the diameter of a cutting head assembly according to the invention.
Figure 13:
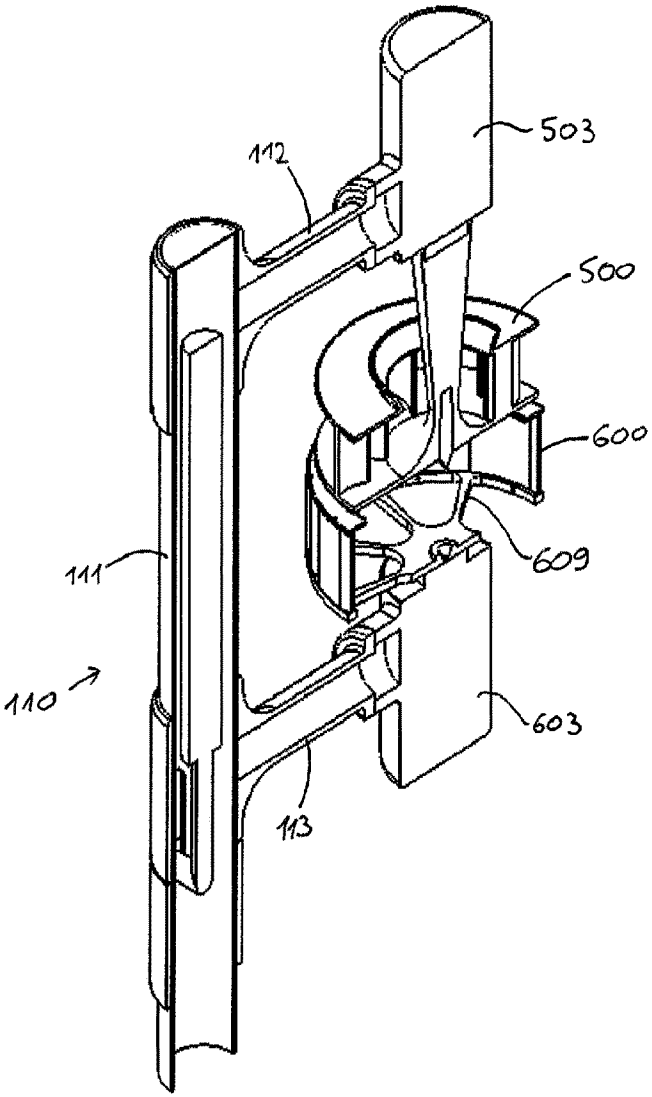

FIG. 4 shows another embodiment of a cutting head assembly 400 according to the invention. It differs from that of FIG. 3 in that there are no mounting rings 213, 214; otherwise, the assembly 400 is the same as the assembly 200. Instead of the mounting rings as sizing elements, the assembly is brought to the correct size by means of a sizing arrangement which comprises a plug 420 (circular member, see FIG. 7) around which the cutting stations 407 are positioned and subsequently the drum is brought to the desired diameter by tightening the bolts at the overlapping parts. When this process is completed, the correctly sized drum is taken from the sizing arrangement 420 and placed on the cutting head support of the cutting apparatus (e.g. the spider support 609 in FIGS. 13-14).

In all embodiments disclosed herein, the cutting head support of the cutting apparatus and the cutting stations are together provided with an appropriate interlocking mechanism (not shown) which can take any form as known in the art and therefore needs no further clarification here. By means of this interlocking mechanism, the cutting head assembly is locked with its drive mechanism. A similar interlocking mechanism can be applied on the top side to lock a top ring or other top part of the cutting head into position with the drum.

In alternative embodiment (not shown), other sizing elements or sizing arrangements can be used to set the correct diameter of the drum, such as for example top and/or bottom rings on the inside of the drum, a bottom plate of the cutting head assembly with a "plug" provided thereon, an outer ring at or near the middle of the drum, etc.

Figure 5:
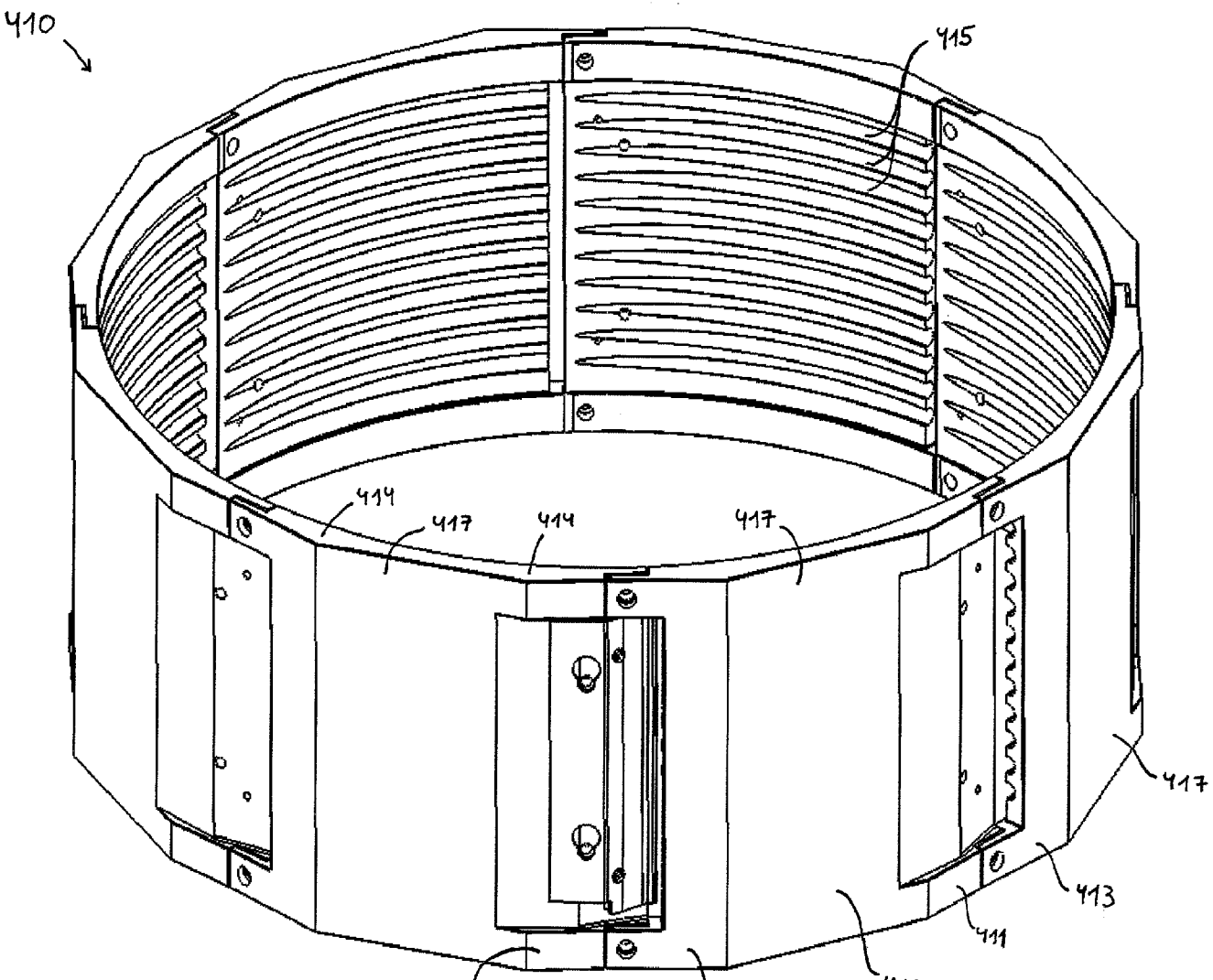
FIG. 5 shows another embodiment of a cutting head assembly according to the invention.

FIG. 5 shows another embodiment of a cutting head assembly 410 according to the invention, comprising cutting stations 417. Again, no mounting rings are provided and the sizing is done by means of the plug 420 shown in FIG. 7. The assembly 410 differs from the assembly 400 only in that the outer surface of the cutting stations 417 is not circular, but angled, so that the drum has a regular polygonal shape on the outside. In particular, each cutting station has an outer wall composed of three planar wall parts (could also be two or four or more in alternative embodiments), a first planar wall part 411 at the front end (where the cutting element is located), a second planar wall part 412 in the middle and a third planar wall part 413 at the rear end (where the cutting element opposing part is located). The angles are such that the first and third planar wall parts 411, 413 of adjacent cutting stations are coplanar. This shape has a constructional advantage: it facilitates manufacture of the cutting stations by extrusion and subsequently makes milling of the grooves into the inner wall of the cutting stations much easier. Another advantage is that the polygonal shape can facilitate assembly of the cutting head, as it can be placed on its side without the risk of it rolling away and flat surfaces are easier to assemble. Still further, as a result of the angled outer surface, the parts 414 of the cutting stations near the gate (cutting element and opposing part) are thicker with respect to the remainder of the cutting stations, so that additional strength is provided.

Figure 6:
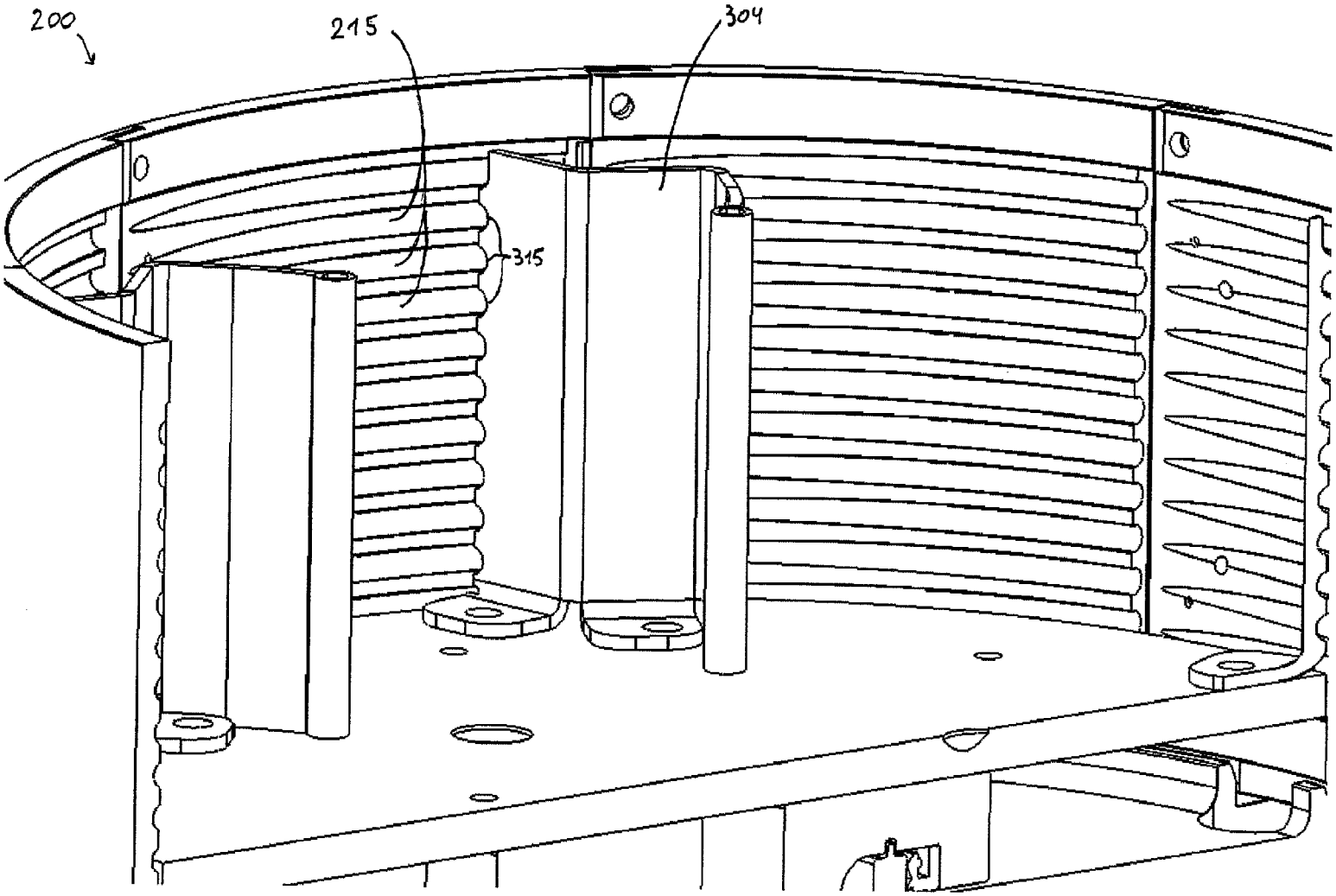
FIG. 6 shows a detail of a centrifugal cutting apparatus according to the invention.

In the embodiments of FIGS. 3-5, the cutting stations are provided with elongate grooves 215, 405, 415 on the inside of the drum for providing relief for stones entering the cutting head along with the product to be cut. On each cutting station, the grooves start at the end where the cutting element is located and gradually increase towards the end where the opposing part is located, so that the grooves reach their maximum depth at this end. The impeller can advantageously be equipped with impeller paddles 304 which have grooves 315 on the outer peripheral edge which align with the grooves on the cutting stations, as shown in FIG. 6.

The cutting apparatus shown in FIGS. 10-14 has many features in common with the cutting apparatus shown in FIG. 2. As a result, only the differences will be explained in detail.

The cutting apparatus shown in FIGS. 10-14 is mainly different in the driving mechanisms used to drive the impeller 500 and the cutting head 600. For both, an in line drive mechanism is used, i.e. the impeller 500 is directly fixed to the shaft of the motor 503 and the cutting head 600 is directly fixed to the shaft of the motor 603. This has the advantage that any intermediate drive components, such as the driving belts and the concentric shafts of the apparatus of FIG. 2 are avoided, which simplifies the construction. The concentric rotation of the impeller 500 inside the cutting head 600 is stabilised by means of a spring-loaded pin 501 which fits into a tapered hole 601 in the centre of the cutting head 600.

The cutting head 600 is in this embodiment an assembly of cutting stations 607, placed on a spider support 609. The spider support 609 is used instead of a full bottom plate in order to save weight. The spider support can be connected to the shaft of the motor 603 by means of notches which are engaged by pins on the shaft. This can be a quick release engagement which can be fixed/loosened by for example turning the spider support 609 over +5°/−5° with respect to the motor shaft. Of course, the spider support 609 could also be bolted to the motor shaft, or releasably fixed by any other means known to the person skilled in the art.

Figure 14:
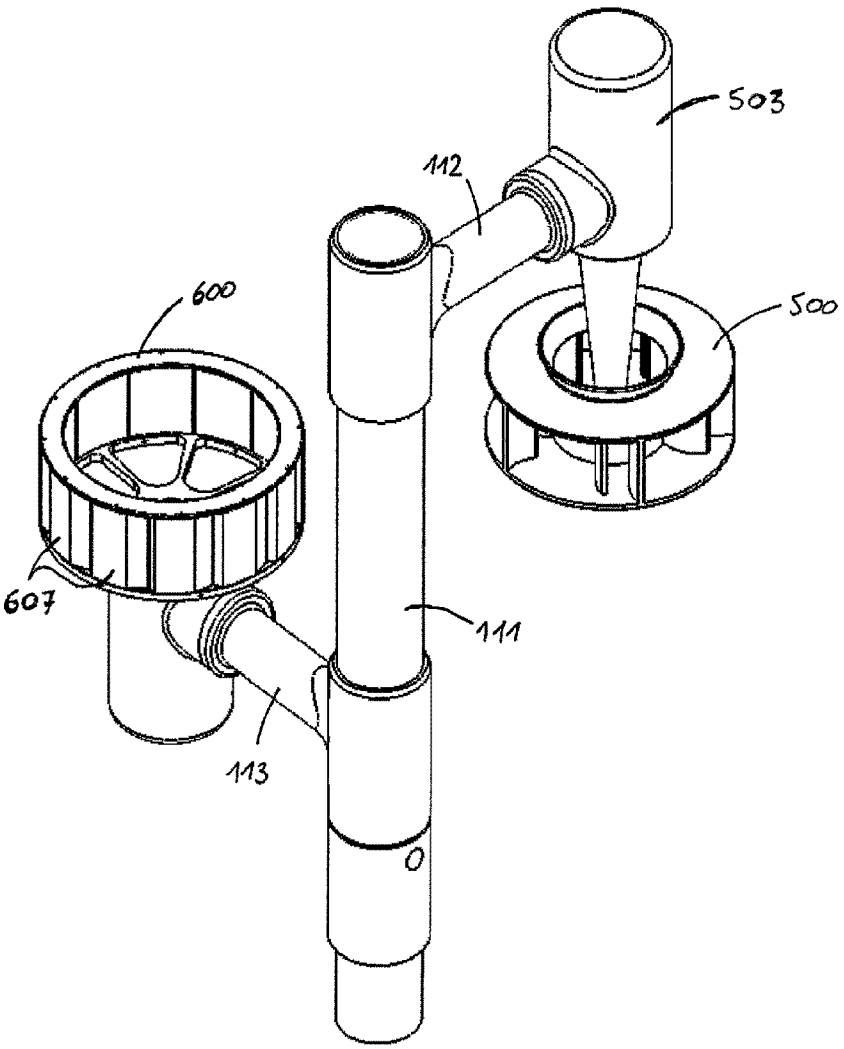

In this embodiment, the base 110 comprises a vertical post 111 with a fixed top arm 112 on which the impeller motor 503 is mounted with the shaft pointing downwards. The cutting head motor 603 is mounted on the post 111 with the shaft pointing upwards by means of a vertically movable and horizontally rotatable arm 113. In this way, the cutting head 600 can be removed from the impeller 500 for maintenance, replacement, etc. by subsequently moving the arm 113 downwards (FIG. 13) and rotating it in a horizontal plane (FIG. 14).

Figure 15:
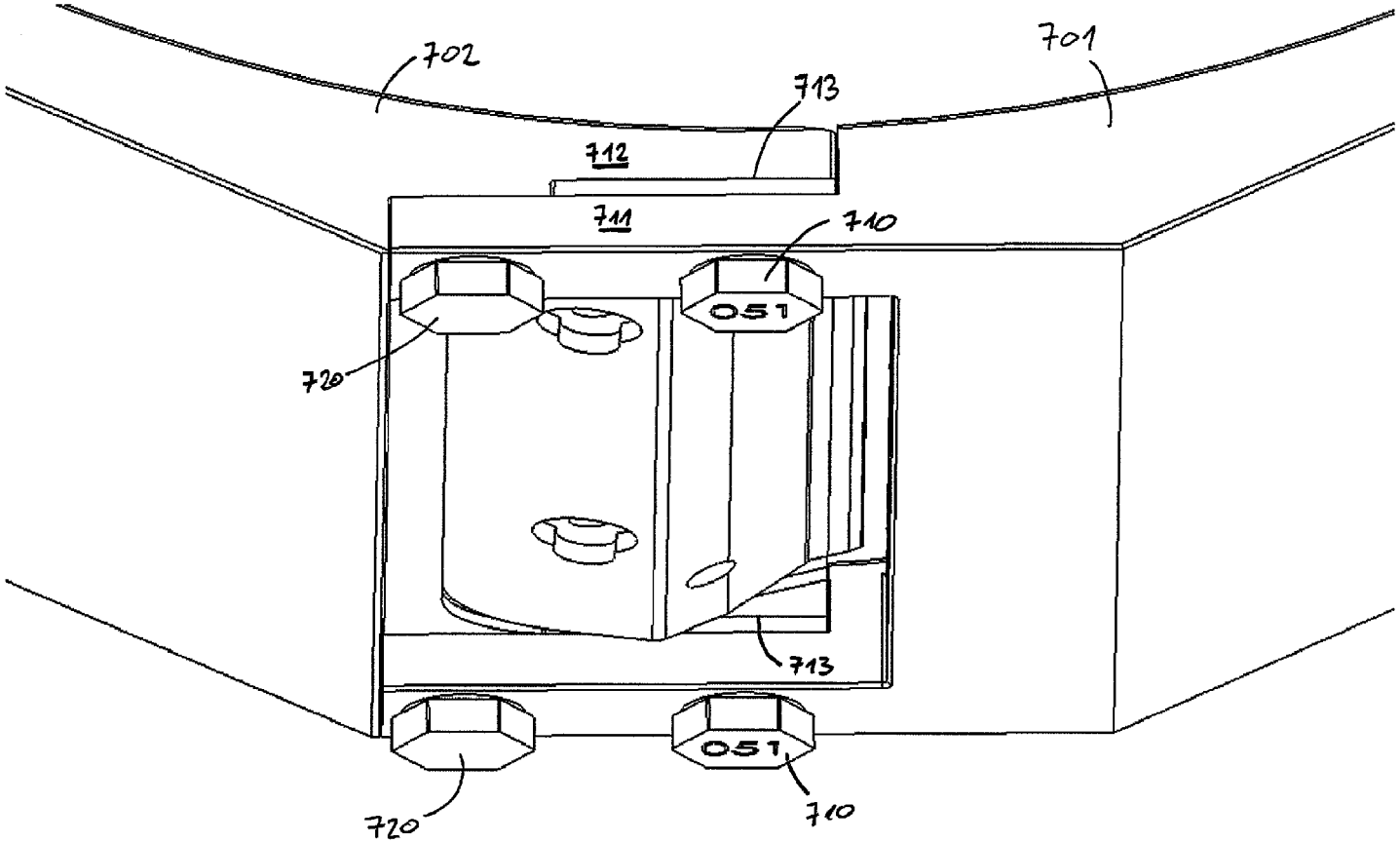
FIGS. 15 and 16 show a detail of another embodiment of a cutting head assembly for a centrifugal cutting apparatus according to the invention.
Figure 16:
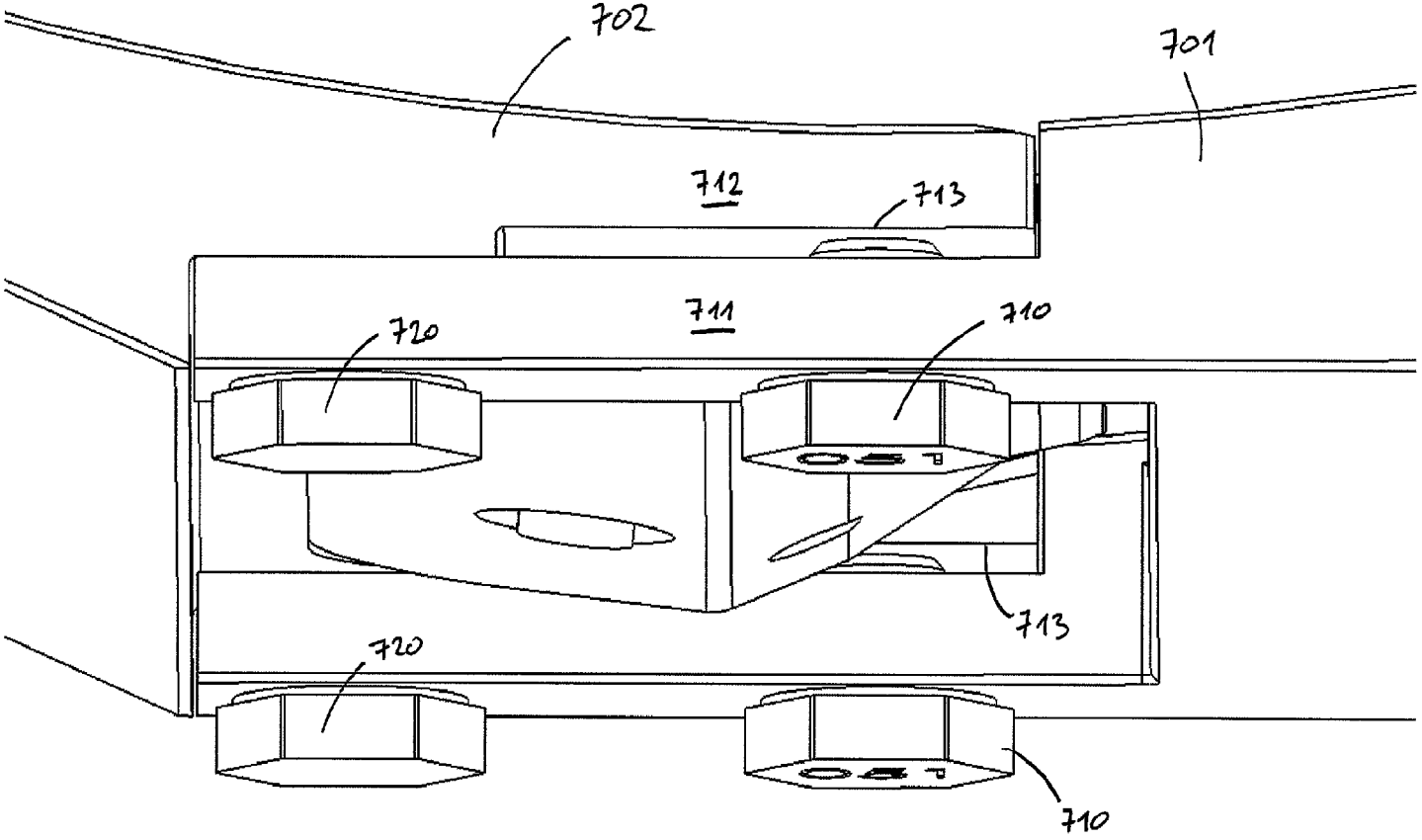

FIGS. 15 and 16 show a detail of another embodiment of a cutting head assembly for a centrifugal cutting apparatus, with alternative gap setting elements. The gap setting elements here comprise a plurality of set screws 710. The overlapping parts 711, 712 of adjacent cutting stations 701, 702 comprise on the one hand bores for receiving the set screws and on the other hand surfaces 713 for abutting the set screws, such that the length of the set screws defines the size of the gap between the cutting element and the opposing part of the subsequent cutting station. In this way, the size of the gap can be easily adjusted by exchanging the set screw for one of another length and tightening the set screw against the opposing surface. The gap width is marked on the screw head, in this case "051". A set of interchangeable set screws can be provided with progressive values, e.g. "050", "051, "052", etc. enabling one to easily select and check. Separate screws 720 take care of fixing the cutting stations to each other.

The invention claimed is:

1. A cutting head for a centrifugal cutting apparatus, the cutting head comprising:

a plurality of drum stations, wherein the plurality of drum stations includes a first cutting station and a second station that is adjacent the first cutting station, the first cutting station having a cutting element at a leading end of the first cutting station for cutting products fed into the cutting head into smaller parts, the second station having an opposing part at a trailing end of the second station;

at least one gap setting element, the at least one gap setting element being provided for setting a size of a gap between the cutting element and the opposing part and thereby defining a slice thickness of the smaller parts which are cut by the cutting element; and fixing parts provided for assembling and holding the plurality of drum stations together to form the cutting head;

wherein the at least one gap setting element comprises a first set screw, wherein the first set screw extends through a bore to abut a peripheral surface thereby defining the size of the gap between the cutting element and the opposing part of the second station;

wherein the fixing parts comprise a first fixing screw, separate from the first set screw, for fixing the position of the opposing part with respect to the cutting element; and wherein the first set screw extends parallel to the first fixing screw.

2. The cutting head according to claim 1, wherein the fixing parts for assembling and holding the plurality of drum stations together further comprise top and bottom mounting parts.

3. The cutting head according to claim 1, wherein said peripheral surface extends in a peripheral direction of the cutting head.

4. The cutting head according to claim 1, wherein the bore of the first set screw is a first bore, wherein the first fixing screw extends through a second bore, and wherein the first and second bores extend from an outer surface of the opposing part through an inner surface of the opposing part.

5. The cutting head according to claim 4, wherein the first and second bores are provided in the second station at a location where the second station overlaps with the first cutting station.

6. The cutting head according to claim 1, wherein the plurality of drum stations comprises a plurality of cutting stations, wherein the first cutting station is a member of the plurality of cutting stations.

7. A centrifugal cutting apparatus comprising the cutting head according to claim 1, an impeller adapted for being concentrically rotated within the cutting head and a first drive mechanism adapted for driving rotation of the impeller.

8. The centrifugal cutting apparatus according to claim 7, wherein the impeller comprises a plurality of paddles, wherein each paddle is provided with radius grooves on a peripheral edge of the paddle to provide relief for small stones which may accidentally enter the cutting head.

9. The centrifugal cutting apparatus according to claim 8, wherein the radius grooves are aligned with corresponding grooves in the drum stations of the cutting head.

10. A cylindrical cutting head for a centrifugal cutting apparatus, the cylindrical cutting head comprising:

a plurality of drum stations, wherein the plurality of drum stations includes a first cutting station and a second station that is adjacent the first cutting station, the first cutting station having a cutting element at a leading end of the first cutting station, the second station having an opposing part at a trailing end of the second station;

at least one gap setting element, the at least one gap setting element being provided for setting a size of a gap between the cutting element and the opposing part and thereby defining a slice thickness of parts which are cut by the cutting element; and fixing parts provided for assembling and holding the plurality of drum stations together to form the cutting head;

wherein the at least one gap setting element comprises a first set screw;

wherein the first set screw extends through the opposing part and abuts a peripheral surface such that a length of the first set screw determines the size of the gap, wherein said peripheral surface extends in a peripheral direction of the cutting head.

11. The cutting head according to claim 10, wherein the fixing parts comprise a first fixing screw, wherein the first fixing screw extends through a bore in a radial direction of the cutting head.

12. The cutting head according to claim 10, wherein the plurality of drum stations comprises a plurality of cutting stations, and wherein the first cutting station is a member of the plurality of cutting stations.

13. The cutting head according to claim 10, wherein the fixing parts for assembling and holding the plurality of drum stations together further comprise top and bottom mounting parts.

* * * * *